US006314953B1

(12) United States Patent
Wolters

(10) Patent No.: US 6,314,953 B1
(45) Date of Patent: Nov. 13, 2001

(54) METHOD AND SYSTEM FOR REGULATING THE AIR/FUEL STREAM FED TO AN INTERNAL-COMBUSTION ENGINE

(75) Inventor: Leendert Wolters, Rhoon (NL)

(73) Assignee: Rho-Con Consultancy B.V., Rhoon (NL)

( * ) Notice: Subject to any disclaimer, the term of this patent is extended or adjusted under 35 U.S.C. 154(b) by 0 days.

(21) Appl. No.: 09/500,785

(22) Filed: Feb. 9, 2000

(51) Int. Cl.[7] ..... F02D 41/14
(52) U.S. Cl. ..... 123/704
(58) Field of Search ..... 123/704, 438, 123/587

(56) References Cited

U.S. PATENT DOCUMENTS 4,388,904 * 6/1983 Masaki ..... 123/704
4,686,951 * 8/1987 Snyder ..... 123/704
5,632,248 * 5/1997 Sigii ..... 123/438

* cited by examiner

*Primary Examiner*—Andrew M. Dolinar
(74) *Attorney, Agent, or Firm*—Young & Thompson

(57) ABSTRACT

Method and system for regulating the composition of an air/fuel stream supplied to an internal-combustion engine, comprise determining the mixture flow of the stream, the energy concentration of the air/fuel stream being measured and, from this, the desired mixture flow being determined and compared with the prevailing mixture flow and, if appropriate, correction of the air/fuel composition being carried out. Measuring the mixture strength may consist in the catalytic combustion of part of the mixture and determining the resulting temperature increase. The mixture flow can be determining by measuring the rotational speed of the engine and its inlet pressure and inlet temperature. Instead of comparing the determined and desired mixture flow, it is also possible to compare the prevailing and desired energy concentration and then to carry out a correction.

6 Claims, 2 Drawing Sheets

Figure 1:
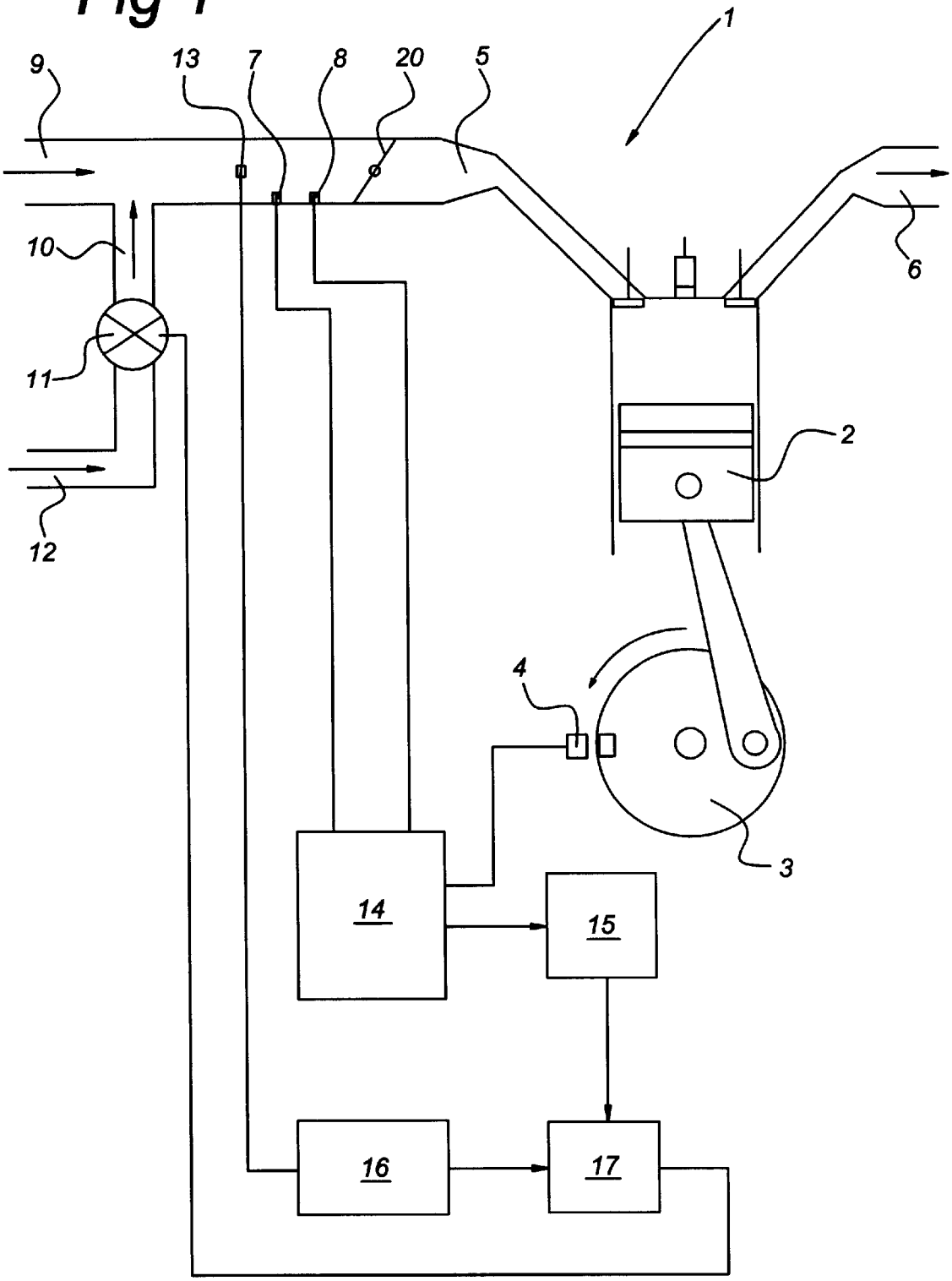

METHOD AND SYSTEM FOR REGULATING THE AIR/FUEL STREAM FED TO AN INTERNAL-COMBUSTION ENGINE

BACKGROUND OF THE INVENTION

The present invention relates to a method and regulating system for regulating the air/fuel ratio fed to an internal-combustion engine. An internal-combustion engine of this type may comprise any internal-combustion engine which is known in the prior art, such as a diesel engine or spark-ignition engine, which may operate using either the two-stroke or the four-stroke principle.

The authorities are imposing ever higher demands on emissions from such engines. One of the emission criteria which is of importance is the $NO_x$, level.

In engines which operate with a known, constant fuel quality, regulation of this nature is comparatively simple to carry out. A so-called lambda sensor is arranged in the exhaust duct and measures the amount of oxygen present. On this basis, the air/fuel ratio can be regulated with the aid of a feedback system.

However, as soon as the calorific value of the fuel fluctuates, a system of this nature has proven to be no longer satisfactory. For example, if an amount of non-combustible gas, such as a gas which reduces a combustion temperature, such as $CO_2$, is fed to a gaseous fuel, the oxygen content in the exhaust gas will change, and a device of this nature will endeavour to make such a mixture leaner by equalizing the oxygen content again. Such a reaction is undesirable. Therefore, it is proposed in the prior art to control the air/fuel ratio in engines which operate under fluctuating conditions in a different way. Examples of how to do this are given in European Application 0,259,382 A in the name of Jenbacher Werke and European Application 0,727,574 A, in the name of Deltec Fuel Systems B.V.

In both cases, the combustion engine is used to drive a generator, and the electric power generated is used as an input for air/fuel regulation. In European Application 0,259,382 A, the pressure in the inlet manifold of the internal-combustion engine is measured and an optimized inlet manifold pressure is determined on the basis of the generator power which is generated. These two inlet manifold pressure values are compared with one another and correction is carried out if necessary.

In European Application 0,727,574 A, the desired efficiency of the engine under operating conditions is determined and compared with the actual efficiency. The efficiency, on the one hand, is a constant value and, on the other hand, is determined from the power of the engine. If there are differences between the measured efficiency and the calculated efficiency, correction is carried out.

For both applications, it is essential that there should be a power output signal.

SUMMARY OF THE INVENTION

The object of the present invention is to propose a method and system in which it is not necessary to use the output generated by the engine, since in many engines the output which they generate is unknown. Examples of such engines are traction motors.

A further object of the present invention is for it to be possible to use such a method and system in both new and existing engines. The invention relates in principle to the use of any type of fuel, gaseous fuel being particularly preferred.

A further object of the invention is for it to be possible to bring about such regulation without active design measures being required on such an engine.

A further object of the present invention is to provide a method and system with which various types of gas can be supplied to an internal-combustion engine while the emissions, and more particularly the $NO_x$, emissions, remain below the prescribed limits and are automatically corrected in the event of the composition changing.

A further object of the present invention is for it to be possible to construct the system from relatively inexpensive parts.

According to one aspect of the invention, the composition of an air/fuel stream supplied to an internal-combustion engine is regulated by determining the mixture flow of said stream, the energy concentration of the air/fuel stream being measured and, from this, the desired mixture flow being determined and compared with the prevailing mixture flow and, if appropriate, correction of the air/fuel composition being carried out.

According to a further aspect of the present invention, the composition of an air/fuel stream supplied to an internal-combustion engine is regulated by determining the mixture flow of the said stream, the energy concentration of the air/fuel stream being measured and, from this, the desired mixture flow being determined from the mixture flow determined, comparing the prevailing and desired energy concentrations and, if appropriate, carrying out correction of the composition of the air/fuel stream.

According to a further aspect of the invention, a system is provided for supplying an optimized air/fuel stream to an internal-combustion engine, comprising sensors and a calculation device for determining the mixture flow supplied to the said engine, means being provided for determining the combustion intensity of said stream, and calculation means also being provided for determining, from this, the desired mixture flow, comparison and correction means being provided for comparing the desired and measured mixture flow and, if appropriate, correcting the air/fuel ratio of the air/fuel stream supplied.

According to a further aspect of the invention, a system is provided for supplying an optimized air/fuel flow to an internal-combustion engine, comprising sensors and a calculation device for determining the mixture flow supplied to said engine, means being provided for determining the combustion intensity of the said stream, as well as calculation means for determining the desired energy concentration from the desired mixture flow, comparison and correction means being provided for comparing the desired and measured mixture strength and, if appropriate, correcting the air/fuel ratio of the air/fuel stream supplied.

DETAILED DESCRIPTION OF THE INVENTION

The invention will be explained in more detail below with reference to an exemplary embodiment which is illustrated in the drawing.

BRIEF DESCRIPTION OF THE INVENTION

Figure 2:
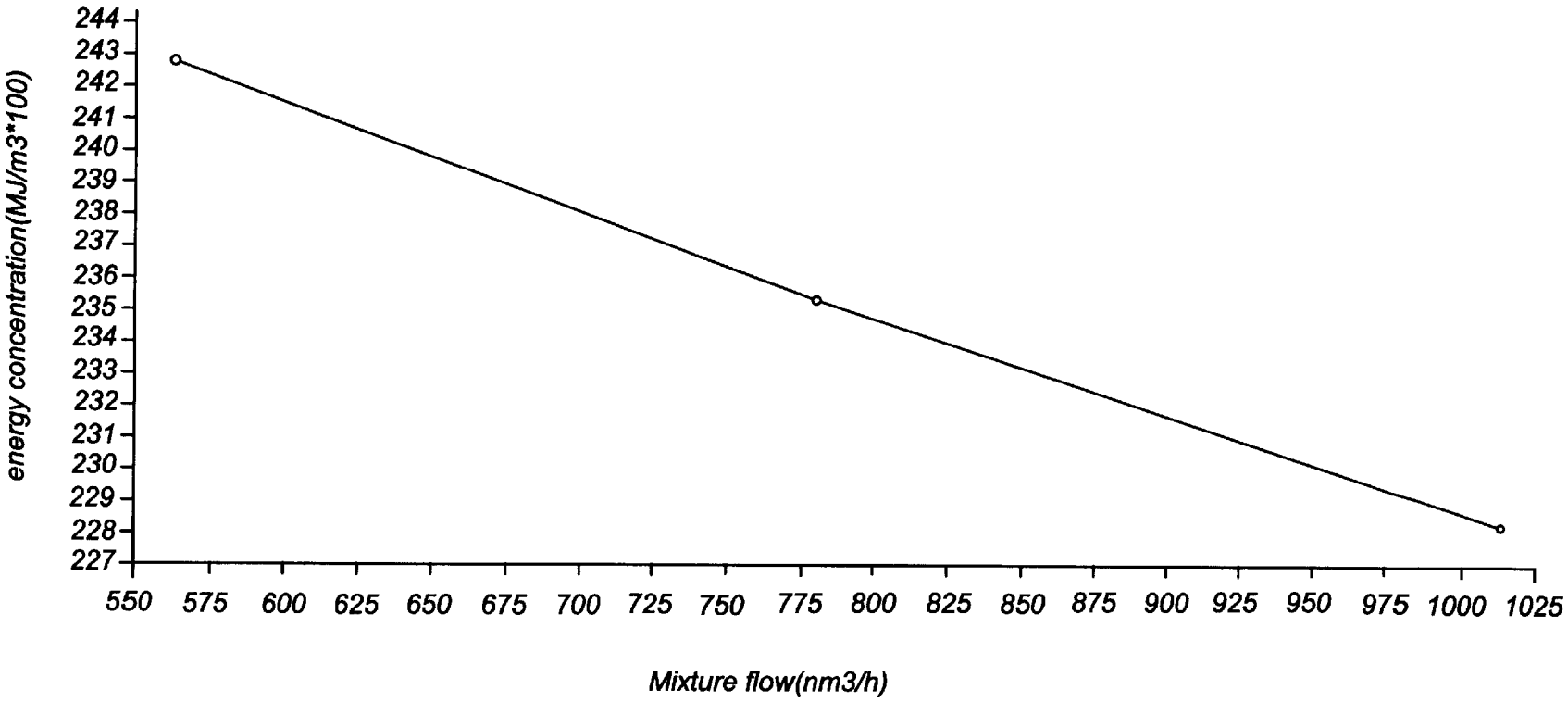

FIG. 1 diagrammatically depicts a preferred embodiment of the invention, and FIG. 2 shows a graph in which the mixture flow and mixture strength are plotted against one another.

DETAILED DESCRIPTION OF THE FIGURES

In FIG. 1, 1 denotes a combustion engine, comprising a piston 2 which is connected to a crankshaft 3. A rotational speed sensor is denoted by 4, and the signal from this sensor is transmitted to a device 14 for determining the mixture flow. The inlet duct of the combustion engine is denoted by 5, and the exhaust duct is denoted by 6. The throttle valve is denoted by 20. The inlet duct contains a temperature sensor 7 and a pressure sensor 8, the signals from which can likewise be fed to device 14. On the basis of the signals from the sensors 4, 7 and 8, it is possible to determine the mixture flow.

13 denotes a sensor which is used to measure the calorific value of the gas/air mixture inside the inlet duct. 9 is the air inlet, while 10 denotes the gas inlet. 11 is a controllable valve which is arranged in a line 12 connected to a gas source. Valve 11 can be controlled with the aid of control unit 17.

The energy concentration is determined in device 16 using the signals from sensor 13. A (three-dimensional) table is stored in device 15, and an optimum energy concentration is read out according to the rotational speed and the mixture flow which is determined in device 14. The value of this optimum energy concentration is output to device 17 and compared with the signal derived from device 16. If the difference exceeds a predetermined value, a correction is carried out by changing the position of shut-off valve 11 and thus changing the gas flow.

FIG. 2 shows a graph illustrating the relationship between the measured mixture flow and the optimized energy concentration at a specific rotational speed. The optimized mixture strength is the mixture strength at which the emissions satisfy the stipulated requirements.

In most existing engine-management systems, the mixture flow is already present. Consequently, it is in fact necessary only to calculate the mixture strength from this parameter and to compare it with the measured mixture strength.

Of course, it is possible to determine the desired mixture flow from the energy concentration determined, i.e. with the aid of a graph which corresponds to that shown in FIG. 2. By comparing the desired mixture flow, i.e. the mixture flow at which the combustion conditions are optimum, with the measured mixture flow in device 14, it is possible to transmit a correction to shut-off valve 11 if the deviation exceeds a stipulated threshold.

The sensor 13 for measuring the calorific value may comprise any sensor which is known in the prior art. It is preferable to use a sensor which operates with catalytic combustion. In this case, two electric conductors, optionally incorporated in a Wheatstone bridge, are connected to an electric current source. As a result, the conductors are heated. As the temperature of the conductors rises, their conductive properties will change (increase or decrease).

One of the conductors is provided with a catalytic material. Consequently, a very small part of the mixture flow supplied will be combusted on the surface of the conductor in question, and the temperature of this conductor will rise. In this way, it is possible to determine the calorific value of the mixture. A sensor of this nature is widely commercially available. It should be understood that other calorific value sensors, such as calorimeters or gas analysers, may also be used, but the use of catalytic sensors is very much preferred to others, since the combustion corresponds very accurately to that which takes place in an engine. Gas which reduces the combustion temperature, such as for example $CO_2$, will result in a lower $NO_x$, formation in an engine, but will also cause a lower combustion temperature in the sensor. This effect is caused by the specific heat of gases. Sensors which operate with a chemical reaction in which an elevated temperature which depends on the quantity of fuel present is generated are preferred, since they approximate to the process in the combustion engine.

In principle, only a single sensor is necessary. The sensors are enclosed by gauze. This makes the sensor suitable for applications in explosion-sensitive environments. As a result, the gas/air mixture cannot be ignited by the sensor. Small holes (nozzles) in the sensor housing are used for the same purpose.

Since such sensors are available at low cost for use in alcohol testers and in LEL meters (lower explosive limit meters), it is possible to use three sensors in order to increase operational reliability. Moreover, this makes it possible to monitor the mixture supplied to different cylinder (banks) separately. With the method and system according to the invention, it is possible to supply an optimum mixture to the combustion engine with a fluctuating gas composition and consequently a fluctuating air/fuel ratio, so that the emissions remain within the limits set. The invention can be employed in particular but not exclusively in relatively lean-running engines which have a relatively low operating temperature, with the result that the $NO_x$, emissions are limited.

On reading the above description, those skilled in the art will immediately find variants which lie within the scope of the appended claims.

What is claimed is:

1. Method for regulating the composition of an air/fuel stream supplied to an internal-combustion engine, which comprises:

determining a mixture flow of said air/fuel stream;

measuring an energy concentration of the air/fuel stream by subjecting a part of the mixture to a catalytic combustion, and determining the resulting temperature increase;

determining, from this measuring step, a desired mixture flow;

comparing the desired mixture flow with the prevailing mixture flow; and if appropriate, carrying out a correction of the composition of the air/fuel stream.

2. The method according to claim 1, wherein the step of determining the mixture flow comprises measuring the rotational speed of the engine, its inlet pressure, and inlet temperature.

3. The method according to claim 1, wherein the step of determining the desired mixture flow comprises using a table or other memory store, working on the basis of the rotational speed of the engine and the energy concentration.

4. Method for regulating the composition of an air/fuel stream supplied to an internal-combustion engine, which comprises:

determining a mixture flow of the air/fuel stream;

measuring an energy concentration of the air/fuel stream by subjecting a part of the mixture to a catalytic combustion, and determining the resulting temperature increase;

determining from this measuring step a desired mixture flow;

comparing the prevailing and desired energy concentrations; and if appropriate, carrying out a correction of the composition of the air/fuel stream.

5. The method according to claim 4, wherein the step of determining the mixture flow comprises measuring the rotational speed of said engine, its inlet pressure, and inlet temperature.

6. The method according to claim 4, wherein the step of determining the desired mixture flow comprises using a table or other memory store, starting from the rotational speed of the engine and the energy concentration.

* * * * *